US010830410B1

(12) United States Patent
Wei et al.

(10) Patent No.: US 10,830,410 B1
(45) Date of Patent: Nov. 10, 2020

(54) LED PROJECTION LAMP

(71) Applicant: SHENZHEN XINGWEI OPTOELECTRONIC TECHNOLOGY CO., lTD., Shenzhen (CN)

(72) Inventors: Rui Wei, Hechi (CN); Dongdong Tian, Nanyang (CN)

(73) Assignee: SHENZHEN XINGWEI OPTOELECTRONIC TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/939,096

(22) Filed: Jul. 27, 2020

(51) Int. Cl.

| | |
|---|---|
| ***F21S 10/06*** | (2006.01) |
| ***F21V 5/00*** | (2018.01) |
| ***F21V 11/16*** | (2006.01) |
| ***F21V 23/02*** | (2006.01) |
| ***F21V 23/06*** | (2006.01) |
| ***F21V 33/00*** | (2006.01) |
| ***F21V 23/04*** | (2006.01) |
| *F21W 131/406* | (2006.01) |
| *F21Y 115/10* | (2016.01) |
| *F21V 14/08* | (2006.01) |

(52) U.S. Cl.
CPC ..... *F21V 5/007* (2013.01); *F21S 10/063* (2013.01); *F21V 5/008* (2013.01); *F21V 11/16* (2013.01); *F21V 23/02* (2013.01); *F21V 23/04* (2013.01); *F21V 23/06* (2013.01); *F21V 33/0056* (2013.01); *F21V 14/08* (2013.01); *F21W 2131/406* (2013.01); *F21Y 2115/10* (2016.08)

(58) Field of Classification Search
CPC ..... F21V 5/007; F21V 5/008; F21V 11/16; F21V 3/0056; F21V 23/02; F21V 23/04; F21V 23/06
See application file for complete search history.

(56) References Cited

U.S. PATENT DOCUMENTS

| | | | | |
|---|---|---|---|---|
| 5,272,604 | A * | 12/1993 | Lin | B04C 5/00 362/101 |
| 9,194,551 | B1 * | 11/2015 | Zhang | G03B 21/2033 |
| 2015/0131288 | A1 * | 5/2015 | Zhang | F21S 8/00 362/277 |
| 2016/0026073 | A1 * | 1/2016 | Zhang | G03B 21/142 353/101 |
| 2017/0082254 | A1 * | 3/2017 | Zhang | F21V 13/02 |
| 2017/0219176 | A1 * | 8/2017 | Chang | F21V 21/0824 |
| 2017/0241623 | A1 * | 8/2017 | Zhang | F21V 31/005 |
| 2019/0078768 | A1 * | 3/2019 | Altamura | F21S 10/063 |
| 2019/0219904 | A1 * | 7/2019 | Burwick | G03B 21/16 |
| 2020/0003379 | A1 * | 1/2020 | Yang | G03B 25/00 |

* cited by examiner

*Primary Examiner* — Zheng Song

(57) ABSTRACT

The present disclosure relates to a field stage lighting, in particular to an LED projection lamp. The LED projection lamp includes an optical lens cover, a first aluminum substrate, a second aluminum substrate, and a first housing. A first glass lens bracket, a glass lens, and a second glass lens bracket are respectively arranged on an upper end of the first aluminum substrate. A water ripple sheet is arranged on a lower end of the first aluminum substrate. Condensing lens is arranged on an upper end of the second aluminum substrate. A motor is arranged on a lower end of the second aluminum substrate. A second housing is arranged on a lower end of the first housing.

6 Claims, 5 Drawing Sheets

LED PROJECTION LAMP

TECHNICAL FIELD

The present disclosure relates to afield stage lighting, in particular to an LED projection lamp.

BACKGROUND

An LED lamp is a chip of electroluminescent semiconductor material that is fixed to a bracket by silver glue or white glue, and then the chip is connected with a circuit board via silver wires or gold wires. And the chip is sealed with epoxy resin around to protect internal core wires. Finally, a shell is installed to complete the LED lamp, so the LED lamp has good shock resistance. The LEDs are capable of directly emitting red, yellow, blue, green, blue, orange, purple, and white light. There are many types of LED lamps, and LED star projection lamps also belong to them, An LED star projection lamp is a decorative lighting device that projects countless stars or snowflakes on walls, ceilings, and lawns. The LED star projection lamp is used indoors, such as KTV boxes, or outdoors, such as courtyards, lawns, and on plants, which creates an atmosphere and decorate a landscape, and has a very wide range of applications in life. However, there are some problem exist in the conventional LED star projection lamp, which are set as follows:

When the conventional star projection lamp is in use, there is a projection phenomenon that causes more and clear patterns to be unable to be projected with fewer light sources, so that a richer dance or starry sky effect cannot be formed. In addition, the projected patterns are unable to be changed, which makes it impossible to project using different motifs.

When the conventional star projection lamp is in use, water ripples cannot be directly projected and imaged in a moving or static state, thus additional components are required for coordinated use, which makes an assembly cumbersome and complicated, and further makes the star projection lamp large in volume.

SUMMARY

To solve the problems in the prior art, the present disclosure provides an LED projection lamp that solves a projection phenomenon that more and clear patterns are unable to be projected with fewer light sources, so that a problem that richer dance or starry sky effect cannot be formed is solved. In addition, problems that water ripples cannot be directly projected and imaged in a moving or static state, and additional components are required for coordinated use, which makes an assembly cumbersome and complicated, and further makes the star projection lamp large in volume are solved in the present disclosure.

To achieve the above object, the present disclosure provides an LED projection lamp. The LED projection lamp comprises an optical lens cover, a first aluminum substrate, a second aluminum substrate, and a first housing. A first glass lens bracket, a glass lens, and a second glass lens bracket are respectively arranged on an upper end of the first aluminum substrate. A water ripple sheet is arranged on a lower end of the first aluminum substrate. Condensing lens is arranged on an upper end of the second aluminum substrate. A motor is arranged on a lower end of the second aluminum substrate. A second housing is arranged on a lower end of the first housing.

In one embodiment, the optical lens cover is arranged above the second glass lens bracket and the second aluminum substrate. The optical lens cover is arranged on a top end of the first housing. The optical lens cover comprises a plurality of groups of small lenslets. A number of the lenslets, of each group are greater than twenty. A shape of the optical lens cover is selected from a cylindrical structure, a diamond structure, a square structure or an elliptical structure. A shape of each lenslet is polygonal.

In one embodiment, the glass lens is arranged at the lower end of the first glass lens bracket. The second glass lens bracket is arranged on a lower end of the glass lens. The glass lens is fixed to the first aluminum substrate through the first glass lens bracket and the second glass lens bracket, and the glass lens is arranged above the first aluminum substrate. A center of the glass lens and a center of the first aluminum substrate are concentric.

In one embodiment, a shape of the glass lens is selected from rectangular, circular, square or polygonal, and the glass lens is made of glass, plastic or metal sheet. A size of the first aluminum substrate is greater than a size of the glass lens. The first aluminum substrate is fixedly arranged on a fixed support or the second housing.

In one embodiment, the water ripple sheet is arranged on an upper end of the condensing lens. The water ripple sheet, the condensing lens, and the second aluminum substrate are fixedly arranged on an upper end of the motor. The motor is fixedly arranged on a bottom end of the second aluminum substrate. The condensing lens is placed under the first aluminum substrate and fixed on the second aluminum substrate. The condensing lens is made of transparent materials, and the transparent materials are selected from glass or crystal. The condensing lens is a reflector, and a shape of the condensing lens is of a cylindrical structure, a rectangular parallelepiped, an ellipse, or a sphere.

In one embodiment, a print circuit board (PCB) power board is arranged on one side of the motor, a TYPE-C port is arranged on a top end of the PCB power board, and buttons are provided on one side of the TYPE-C port. A button cap is sleeved on an outer wall of each button; and a loudspeaker is sleeved on an outer wall of the motor.

When in use, through cooperation of the optical lens cover, the first glass lens bracket, the glass lens, the second glass lens bracket, the first aluminum substrate, and the water ripple sheet, the LED projection lamp realizes the projection phenomenon that more and clear patterns are projected with fewer light sources. Meanwhile, the richer dance or starry sky effect is formed by combining with an effect of the water ripple sheet. In addition, a projection pattern is changeable by replacing the glass lens, so that the LED projection lamp realizes projection of different theme patterns.

When the LED projection lamp is in use, through cooperation of the water ripple sheet, the condensing lens, the second aluminum substrate, and the motor, LED light source first condenses through the condensing lens, and then passes through the water ripple sheet, and finally a projection image is projected through the optical lens cover. Meanwhile, the water ripple sheet is rotated by the motor, when the LED light source passes through the water ripple sheet, the water ripples projected are capable of switching between a moving state or a static state, which is simple and convenient in operation. In the present disclosure, two effects of water ripples and multi-pattern projection share a multi-in-one lens, a relatively small structure space is used, which realize a rich pattern and watermark combination effect.

1. optical lens cover, 2. first glass lens bracket; 3. glass lens; 4. second glass lens bracket; 5. first aluminum substrate; 6. water ripple sheet; 7. condensing lens; 8. second aluminum substrate; 9. motor; 10. PCB power board; 11 TYPE-C port; 12. button; 13. button cap; 14. loudspeaker; 15. first housing; and 16. second housing.

DETAILED DESCRIPTION

Technical solutions in embodiments of the present disclosure will be described clearly and completely in conjunction with the drawings in the embodiments of the present disclosure. Obviously, the described embodiments are only parts of the embodiments of the present disclosure, but not all of them. It should be understood that based on the embodiments in the present disclosure, other embodiments obtained by those of ordinary skill in the art without creative efforts fall within the protection scope of the present disclosure.

Figure 1:
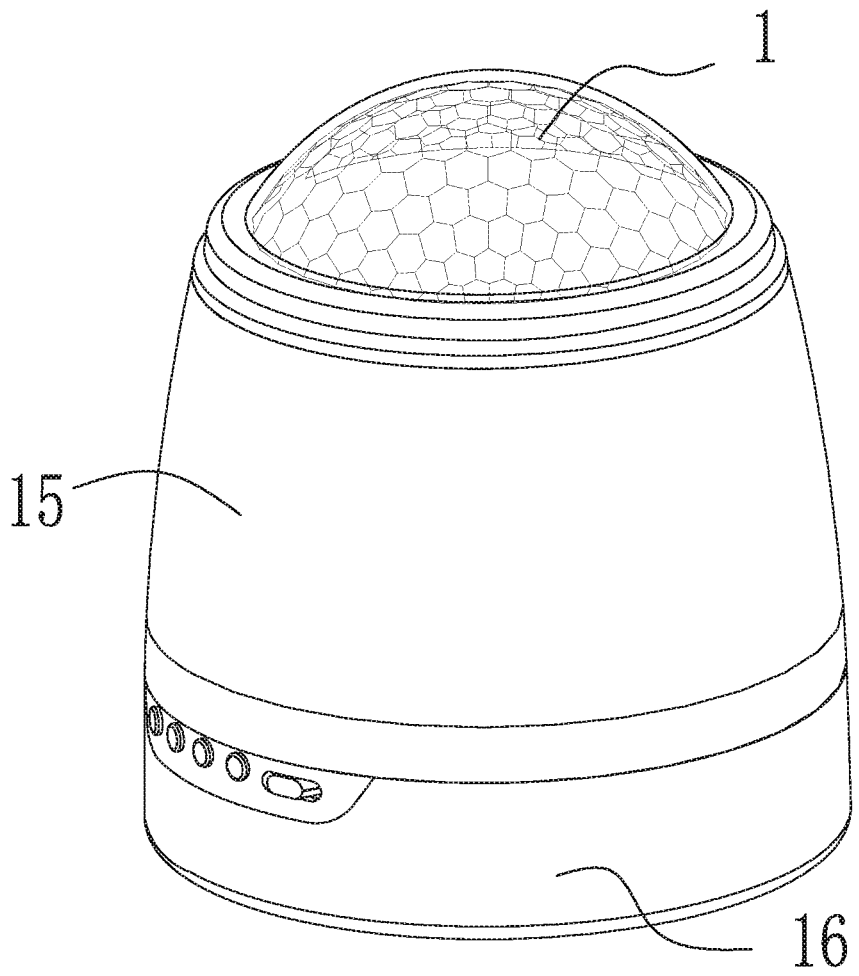
FIG. 1 is a perspective view of the present disclosure.
Figure 2:
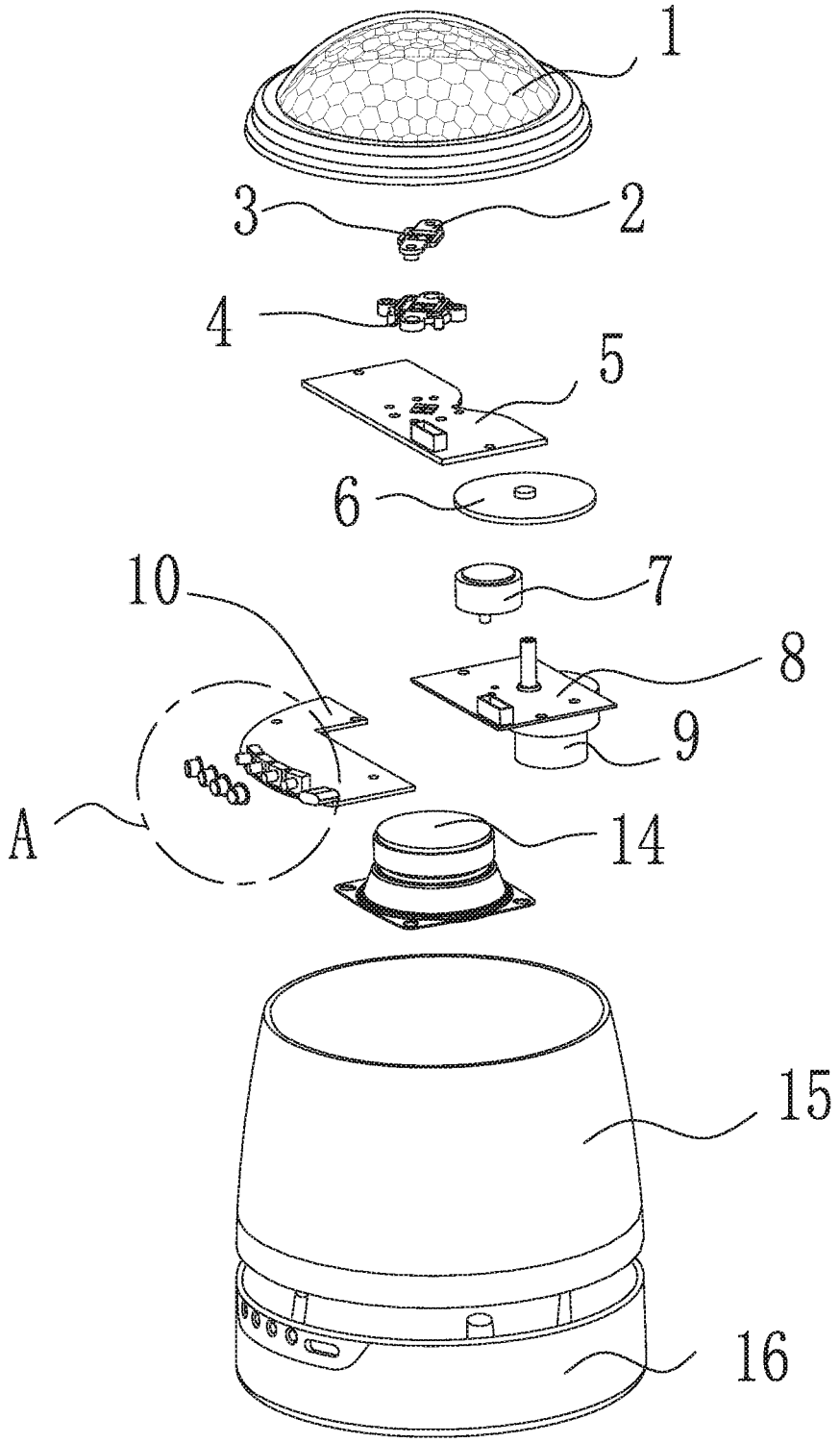
FIG. 2 is an exploded view of the present disclosure.
Figure 3:
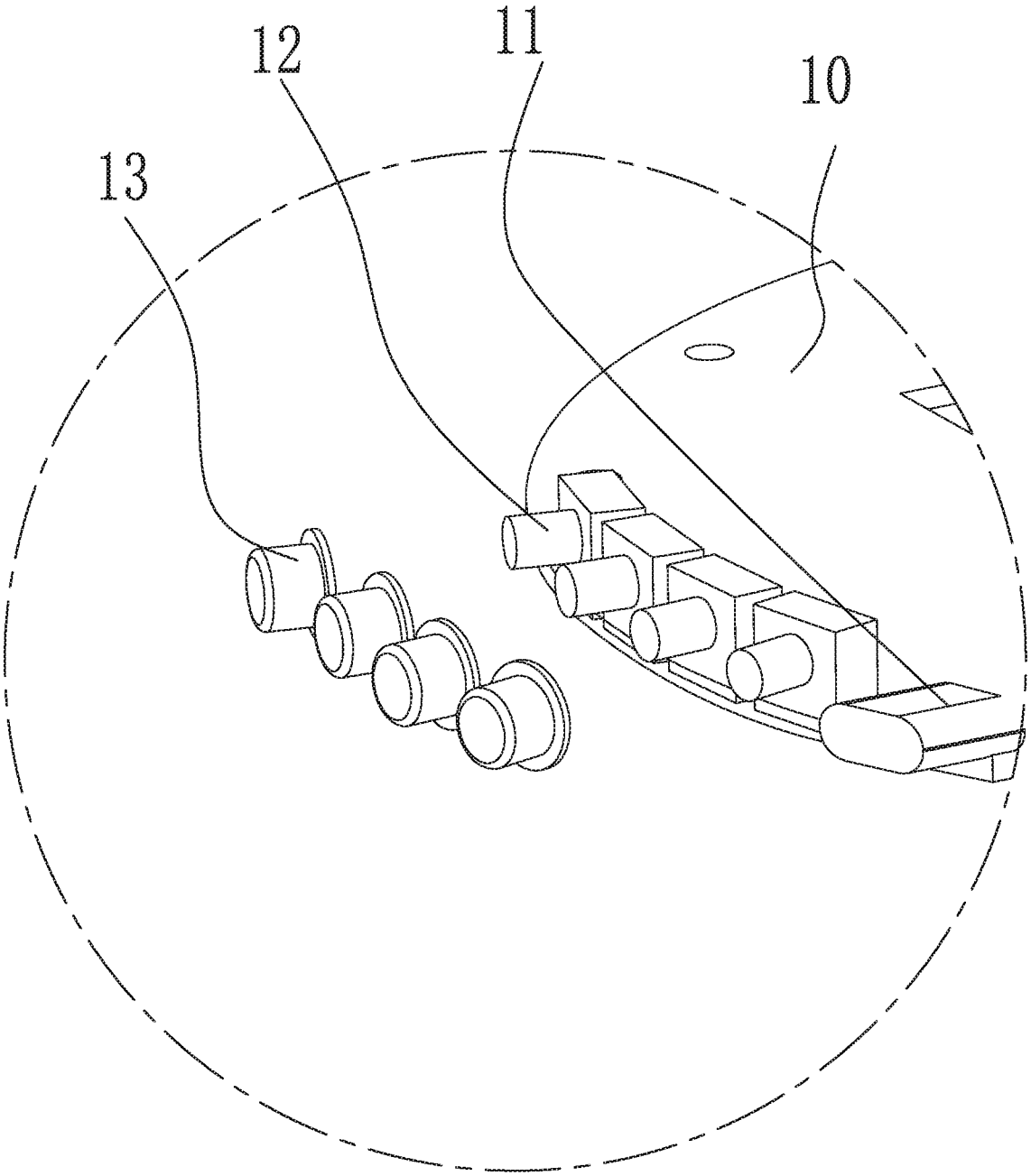
FIG. 3 is an enlarged view of portion A shown in FIG. 2.
Figure 4:
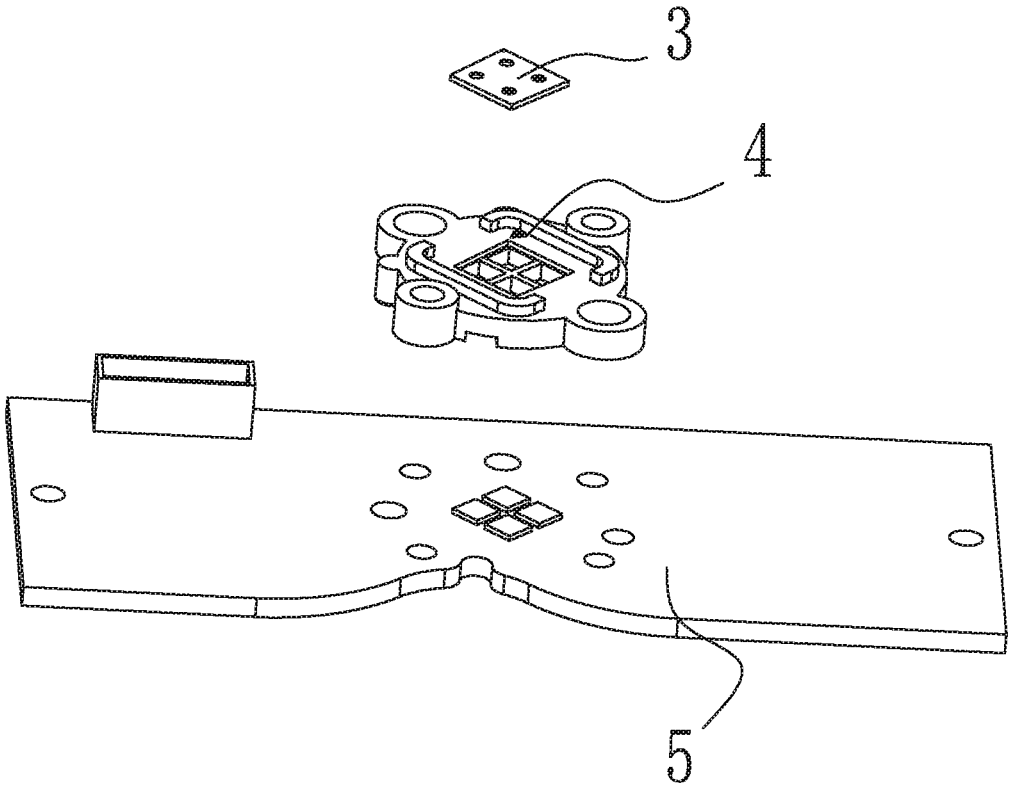
FIG. 4 is an exploded view of portions of the present disclosure.
Figure 5:
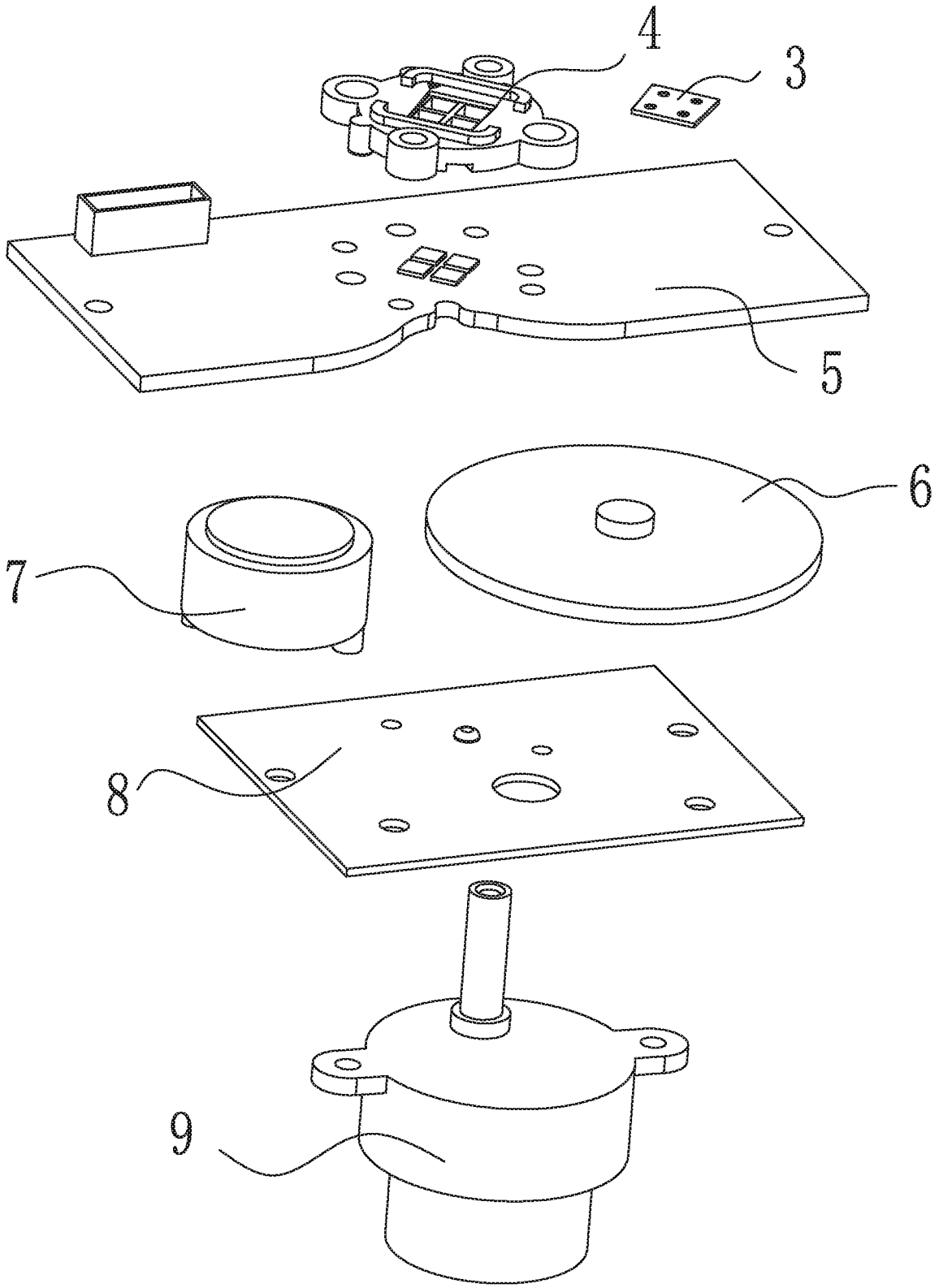
FIG. 5 is another exploded view of portions of the present disclosure.

As shown in FIGS. 1-5, the present disclosure provides an LED projection lamp. The LED projection lamp comprises an optical lens cover 1, a first aluminum substrate 5, a second aluminum substrate 8, and a first housing 15. A first glass lens bracket 2, a glass lens 3, and a second glass lens bracket 4 are respectively arranged on an upper end of the first aluminum substrate 5. A water ripple sheet 6 is arranged on a lower end of the first aluminum substrate 5. Condensing lens 7 is arranged on an upper end of the second aluminum substrate 8. A motor 9 is arranged on a lower end of the second aluminum substrate 8. A second housing 16 is arranged on a lower end of the first housing 15. When in use, through cooperation of the optical lens cover 1, the first glass lens bracket 2, the glass lens 3, the second glass lens bracket 4, the first aluminum substrate 5, and the water ripple sheet 6, the LED projection lamp realizes a projection phenomenon that more and clear patterns are projected with fewer light sources. Meanwhile, a richer dance or starry sky effect is formed by combining with an effect of the water ripple sheet 6. In addition, a projection pattern is changeable by replacing the glass lens 3, so that the LED projection lamp realizes projection of different theme patterns. When the LED projection lamp is in use, through cooperation of the water ripple sheet 6, the condensing lens 7, the second aluminum substrate 8, and the motor 9, LED light source first condenses through the condensing lens 7, and then passes through the water ripple sheet 6, and finally a projection image is projected through the optical lens cover 1. Meanwhile, the water ripple sheet 6 is rotated by the motor 9, when the LED light source passes through the water ripple sheet 6, the water ripples projected are capable of switching between a moving state or a static state, which is simple and convenient in operation. In the present disclosure, two effects of water ripples and multi-pattern projection share a multi-in-one lens, a relatively small structure space is used, which realize a rich pattern and watermark combination effect.

In one embodiment, the optical lens cover 1 is arranged above the second glass lens bracket 4 and the second aluminum substrate 8. The optical lens cover 1 is arranged on a top end of the first housing 15. The optical lens cover 1 comprises a plurality of groups of small lenslets. A number of the lenslets, of each group are greater than twenty. A shape of the optical lens cover 1 is selected from a cylindrical structure, a diamond structure, a square structure or an elliptical structure. A shape of each lenslet is polygonal. The optical lens cover 1 makes the two effects of water ripples and multi-pattern projection realized by sharing the multi-in-one lens.

In one embodiment, the glass lens 3 is arranged at the lower end of the first glass lens bracket 2. The second glass lens bracket 4 is arranged on a lower end of the glass lens 3. The glass lens 3 is fixed to the first aluminum substrate through the first glass lens bracket 2 and the second glass lens bracket 4, and the glass lens 3 is arranged above the first aluminum substrate 5. A center of the glass lens 3 and a center of the first aluminum substrate 5 are concentric.

In one embodiment, a shape of the glass lens 3 is selected from rectangular, circular, square or polygonal, and the glass lens 3 is made of glass, plastic or metal sheet. A size of the first aluminum substrate 5 is greater than a size of the glass lens 3. The first aluminum substrate 5 is fixedly arranged on a fixed support or the second housing 16. When in use, through cooperation of the optical lens cover 1, the first glass lens bracket 2, the glass lens 3, the LED projection lamp realizes the projection phenomenon that more and clear patterns are projected with fewer light sources. Meanwhile, the richer dance or starry sky effect is formed by combining with the effect of the water ripple sheet 6. In addition, the projection pattern is changeable by replacing the glass lens 3, so that the LED projection lamp realizes the projection of different theme patterns.

In one embodiment, the water ripple sheet 6 is arranged on an upper end of the condensing lens 7. The water ripple sheet 6, the condensing lens 7, and the second aluminum substrate 8 are fixedly arranged on an upper end of the motor 9. The motor 9 is fixedly arranged on a bottom end of the second aluminum substrate 8. The condensing lens 7 is placed under the first aluminum substrate 5 and fixed on the second aluminum substrate 8. The condensing lens 7 is made of transparent materials, and the transparent materials are selected from glass or crystal. The condensing lens 7 is a reflector, and a shape of the condensing lens 7 is of a cylindrical structure, a rectangular parallelepiped, an ellipse, or a sphere. When the LED projection lamp is in use, the LED light source first condenses through the condensing lens 7, and then passes through the water ripple sheet 6, and finally the projection image is projected through the optical lens cover 1. Meanwhile, the water ripple sheet 6 is rotated by the motor 9, when the LED light source passes through the water ripple sheet 6, the water ripples projected are capable of switching between the moving state or the static state.

In one embodiment, a print circuit board (PCB) power board 10 is arranged on one side of the motor 9, and a TYPE-C port 11 is arranged on a top end of the PCB power board 10, and buttons 12 are provided on one side of the TYPE-C port 11. A button cap 13 is sleeved on an outer wall of each button 12; and a loudspeaker 14 is sleeved on an outer wall of the motor 9. The PCB power board 10 provides power for the LED projection lamp. The loudspeaker 14 plays a role of sound amplification, and the first housing 15 and the second housing 16 are configured to protect internal components of the LED projection lamp.

The working principle and use flow of the present disclosure is as follow: when in use, the LED projection lamp is first fixedly mounted on a mounting base through a mounting block, When the LED projection lamp is in use, through the cooperation of the water ripple sheet 6, the condensing lens 7, the second aluminum substrate 8, and the motor 9, the LED light source first condenses through the condensing lens 7, and then passes through the water ripple sheet 6, and finally the projection image is projected through the optical lens cover 1. Meanwhile, the water ripple sheet 6 is rotated by the motor 9, when the LED light source passes through the water ripple sheet 6, the water ripples projected are capable of switching between the moving state or the static state, which is simple and convenient in operation. In the present disclosure, two effects of water ripples and multi-pattern projection share the multi-in-one lens, a relatively small structure space is used, which realize the rich pattern and watermark combination effect. In addition, when in use, through the cooperation of the optical lens cover 1, the first glass lens bracket 2, the glass lens 3, the second glass lens bracket 4, the first aluminum substrate 5, and the water ripple sheet 6, the LED projection lamp realizes the projection phenomenon that more and clear patterns are projected with fewer light sources. Meanwhile, the richer dance or starry sky effect is formed by combining with the effect of the water ripple sheet 6. Moreover, the projection pattern is changeable by replacing the glass lens 3, so that the LED projection lamp realizes projection of different theme patterns.

Finally, it should be noted that the above is only optional embodiments of the present disclosure, and are not used to limit the present disclosure, although the present disclosure is described in detail with reference to the foregoing embodiments, for those skilled in the art, they can still modify the technical solutions described in the foregoing embodiments, or equivalently replace some of the technical features. Any modification, equivalent replacement, improvement, etc. made within the spirit and principle of the present disclosure should be included in the protection scope of the present disclosure.

What is claimed is:

1. An LED projection lamp, comprising:

an optical lens cover, a first aluminum substrate, a second aluminum substrate, and a first housing with the first aluminum substrate and the second aluminum substrate disposed within;

wherein a first glass lens bracket, a glass lens, and a second glass lens bracket are respectively arranged on an upper end of the first aluminum substrate; a water ripple sheet is arranged on a lower end of the first aluminum substrate; a condensing lens is arranged on an upper end of the second aluminum substrate; and a motor is arranged on a lower end of the second aluminum substrate, a second housing is arranged on a lower end of the first housing;

wherein the water ripple sheet is arranged on an upper end of the condensing lens; the water ripple sheet, the condensing lens, and the second aluminum substrate are fixedly arranged on an upper end of the motor; the motor is fixedly arranged on a bottom end of the second aluminum substrate, the condensing lens is placed under the first aluminum substrate and fixed on the second aluminum substrate;

wherein the optical lens cover is arranged on a top end of the first housing.

2. The LED projection lamp according to claim 1, wherein the optical lens cover is arranged above the second glass lens bracket 4 and the second aluminum substrate; and the optical lens cover comprises a plurality of groups of small lenslets, and a number of the lenslets, of each group are greater than twenty, a shape of the optical lens cover is selected from a cylindrical structure, a diamond structure, a square structure or an elliptical structure; a shape of each lenslet is polygonal.

3. The LED projection lamp according to claim 1, wherein the glass lens is arranged at the lower end of the first glass lens bracket; and the second glass lens bracket is arranged on a lower end of the glass lens; the glass lens is fixed to the first aluminum substrate through the first glass lens bracket and the second glass lens bracket, and the glass lens is arranged above the first aluminum substrate, a center of the glass lens and a center of the first aluminum substrate are concentric.

4. The LED projection lamp according to claim 1, wherein a shape of the glass lens is selected from rectangular, circular, square or polygonal, and the glass lens is made of glass, plastic or metal sheet; a size of the first aluminum substrate is greater than a size of the glass lens; and the first aluminum substrate is fixedly arranged on a fixed support or the second housing.

5. The LED projection lamp according to claim 1, the condensing lens is made of transparent materials selected from glass or crystal; the condensing lens is a reflector, and a shape of the condensing lens is of a cylindrical structure, a rectangular parallelepiped, an ellipse, or a sphere.

6. The LED projection lamp according to claim 1, wherein a print circuit board (PCB) power board is arranged on one side of the motor, a TYPE-C port is arranged on a top end of the PCB power board, and buttons are provided on one side of the TYPE-C port, a button cap is sleeved on an outer wall of each button; and a loudspeaker is sleeved on an outer wall of the motor.

* * * * *